US006964115B2

(12) United States Patent
Kim

(10) Patent No.: US 6,964,115 B2
(45) Date of Patent: Nov. 15, 2005

(54) LEVELLING ROD FOR BUILDING CONSTRUCTION

(76) Inventor: Jin Sul Kim, 553-588, Jayang3-dong, Kwangjin-gu, Seoul 143-193 (KR)

( * ) Notice: Subject to any disclaimer, the term of this patent is extended or adjusted under 35 U.S.C. 154(b) by 0 days.

(21) Appl. No.: 10/480,458

(22) PCT Filed: Jun. 12, 2002

(86) PCT No.: PCT/KR02/01104

§ 371 (c)(1),
(2), (4) Date: Dec. 8, 2003

(87) PCT Pub. No.: WO02/101176

PCT Pub. Date: Dec. 19, 2002

(65) Prior Publication Data

US 2004/0168330 A1 Sep. 2, 2004

(30) Foreign Application Priority Data

Jun. 12, 2001 (KR) ..... 2001-32984

(51) Int. Cl.[7] ..... E04G 21/10; G01B 5/18

(52) U.S. Cl. ..... 33/834; 33/518; 52/127.3; 116/227

(58) Field of Search ..... 33/834, 832, 833, 33/518, 1 H, 1 G, 293, 483, 484, 485, 489, 33/719, 721, 722, 723, 613; 52/126.1, 127.3, 52/367, 105, 677; 116/227, DIG. 16; 403/194, 403/326, 329

(56) References Cited

U.S. PATENT DOCUMENTS 907,329 A * 12/1908 Fusco ..... 33/413
1,264,189 A * 4/1918 Keator ..... 52/105
1,996,371 A * 4/1935 Fullman ..... 52/220.1
2,523,255 A * 9/1950 Coleman ..... 33/413
3,373,535 A * 3/1968 Lankes ..... 52/105
3,378,968 A * 4/1968 Shoemaker ..... 52/155
4,141,310 A * 2/1979 Rich, Jr. ..... 33/293
4,172,913 A * 10/1979 Ballah et al. ..... 428/9
4,649,678 A * 3/1987 Lamson ..... 52/103
4,970,795 A * 11/1990 Woodward et al. ..... 33/293
5,173,004 A * 12/1992 Fahrenkrog ..... 404/72
5,567,074 A * 10/1996 Dovak et al. ..... 403/197
5,657,548 A * 8/1997 Kellar, Sr. ..... 33/405
5,810,272 A * 9/1998 Wallace et al. ..... 242/157 R
5,943,784 A * 8/1999 Hiramine ..... 33/293
6,413,004 B1 * 7/2002 Lin ..... 403/176

FOREIGN PATENT DOCUMENTS

GB 2143883 A * 2/1985 ..... E04G 21/10
KR 97-05548 * 6/1997 ..... E04G 21/10

* cited by examiner

*Primary Examiner*—R. Alexander Smith

(74) *Attorney, Agent, or Firm*—Porter, Wright, Morris & Arthur, LLP

(57) ABSTRACT

A leveling device for leveling floor pavement layers comprises a rod (1) having a hollow (90) therethrough and a fixing flange (11) for fitting with a fixing member at a lower end, a fixing member (3) including an aperture (31) in the center thereof to be releasably coupled with the rod (1), fixing holes (33) on the outer periphery thereof, a finger stop (310) formed at an end of the aperture (31) to be fitted with the fixing flange (11) of the rod (1) and a cap (4) releasably coupled with the hollow (90) of the rod (1).

9 Claims, 9 Drawing Sheets

LEVELLING ROD FOR BUILDING CONSTRUCTION

TECHNICAL FIELD

The present invention relates to a levelling rod for building construction, especially to a gauge rod for levelling the floor of a building. More specifically, the present invention relates to a rod for levelling the floor of houses or buildings in plastering mortar thereon, thus promoting an accurate construction and reducing the cost and time for construction.

BACKGROUND ART

Conventionally, in the finishing construction of plastering mortar on various kinds of buildings such as houses, commercial buildings or underground parking lots, plasterers draw an inkline on the wall of a building and plaster mortar below the inkline along the wall.

However, in remote areas from the wall of a building or on the floor of the building, there is no inkline or criteria of indicating the level of mortar to be put on the floor, and therefore the levelling of the entire floor could not but to rely on the skill or dexterity of plasterers. That is, in conventional constructions using mortar or concrete, levelling the floor of buildings was only dependent on the experience or dexterity of workers, and thus problems were frequently encountered that the surface of the floor was not flat or even, and the floor was partly protruded or caved in.

In this case, an accurate level of mortar on the floor according to a design drawing cannot be obtained, and thus subsequent construction work is required to repair such a defective levelling, which causes the term of construction to be delayed, requires additional building materials such as mortar or concrete, and causes the increase of the costs for materials and the labor costs.

The accurate levelling of the floor of various kinds of buildings has been considerably demanded, but no appropriate devices or instruments have been suggested.

The inventor of the present invention disclosed a device for indicating the level of concrete to keep the floor of buildings flat in prior Korean Utility Model No. 97-109238 as shown in FIG. 1. However, as the device does not comprise a cap in its upper part, problems have been encountered that it is difficult to distinguish the device 100 for indicating the concrete level if excessive concrete were poured on the floor, and on the other hand if concrete were insufficiently supplied, the end of a rod of the device is exposed over the floor of slab.

DISCLOSURE OF THE INVENTION

Accordingly, an object of the present invention is to provide a levelling rod for building construction, which enables the level of aerated concrete poured onto the floor of buildings to be kept constant in accordance with the level required by a design drawing, and thus promoting an accurate construction.

Another object of the present invention is to provide a levelling rod for building construction, which enables a previous accurate calculation of cement or mortar required for the floor construction, and thus prevents unnecessary consumption of cement mortar required for the repair of unlevelled floor of buildings and reduces costs for materials and labor costs.

A further object of the present invention is to provide a levelling rod for building construction, which promotes shortening of the term for construction and prevents a defective construction.

To achieve these objects and other advantages in accordance with the purpose of the present invention, a levelling rod for building construction of the present invention comprises a rod having a hollow therethrough and a fixing flange for fitting with a fixing member at a lower end;

a fixing member including an aperture in the center thereof to be releasably coupled with the rod, fixing holes on the outer periphery thereof, through which the fixing member is fixed on the floor of a building by fixing means, and a finger stop formed at an end of the aperture to be fitted with the fixing flange of the rod; and a cap releasably coupled with the hollow of the rod.

BRIEF DESCRIPTION OF THE DRAWINGS

The accompanying drawings, which are included to provide a further understanding of the present invention and are incorporated in and constitute a part of this specification, illustrate embodiments of the invention and together with the description serve to explain the principles of the invention.

In the drawings.

PREFERRED EMBODIMENTS OF THE INVENTION

Reference will now be made in detail to preferred embodiments of the present invention with reference to the accompanying drawings.

Figure 1:
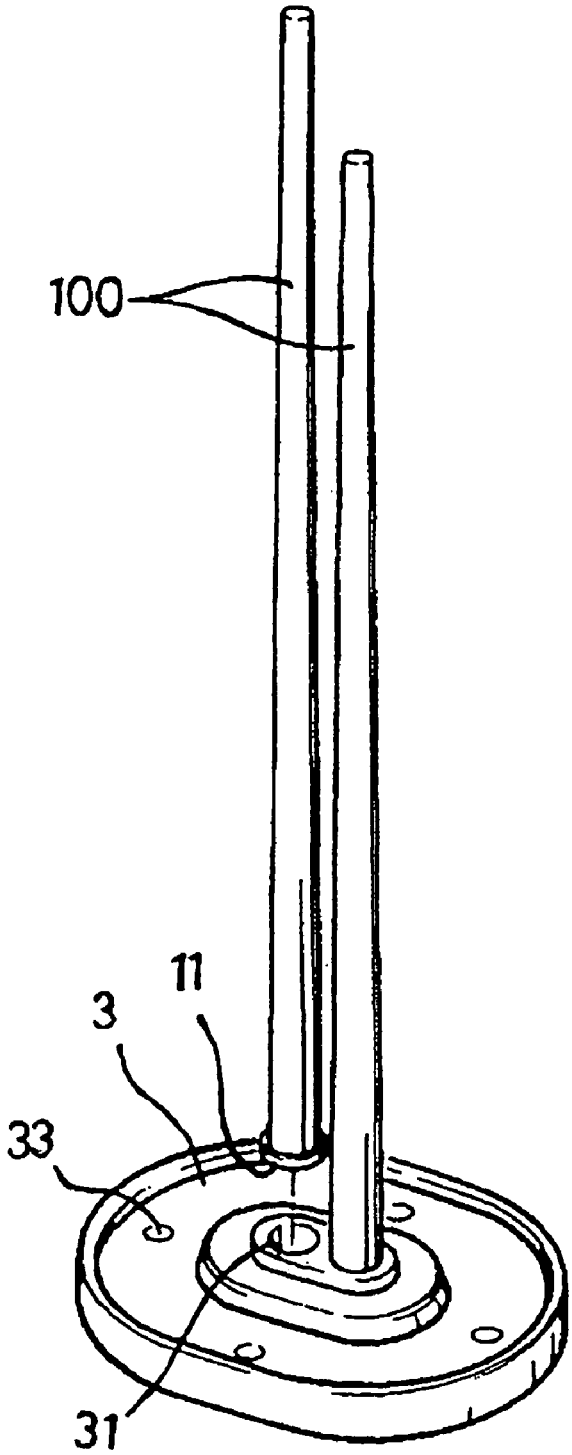
FIG.1 PRIOR ART
FIG. 1 is a disassembled perspective view of conventional levelling rods for concrete.
Figure 2:
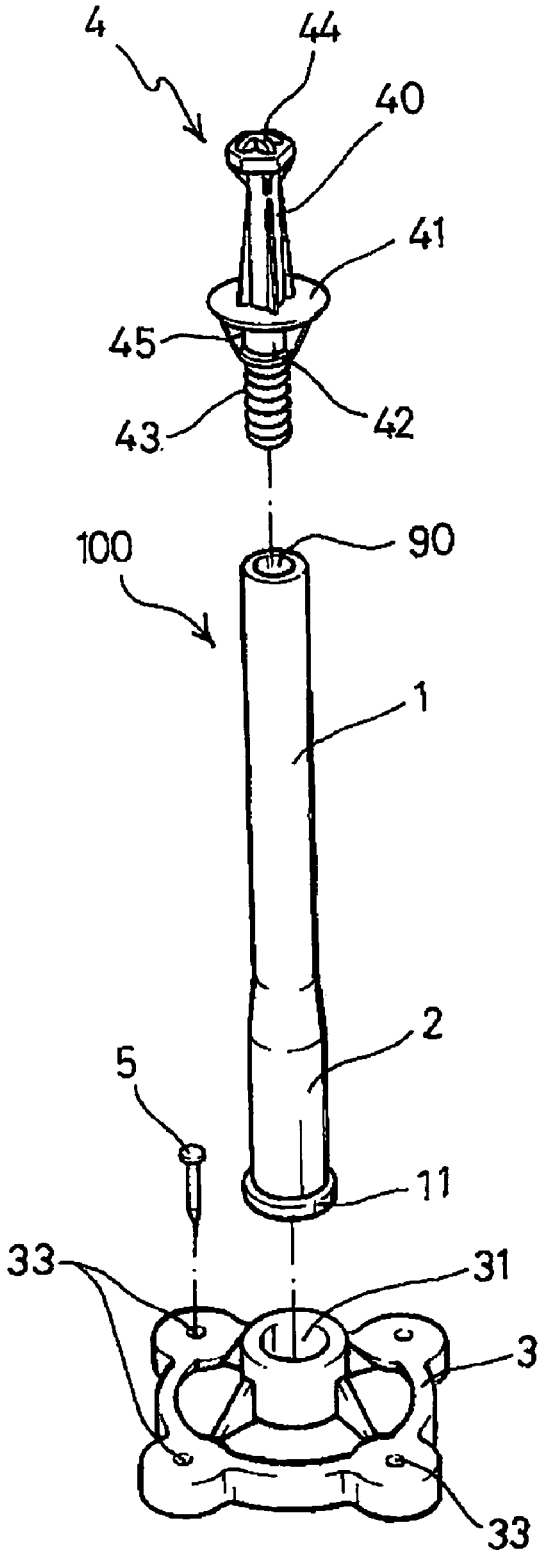
FIG. 2 is a disassembled perspective view of a levelling rod for plaster work according to the present invention.
Figure 3:
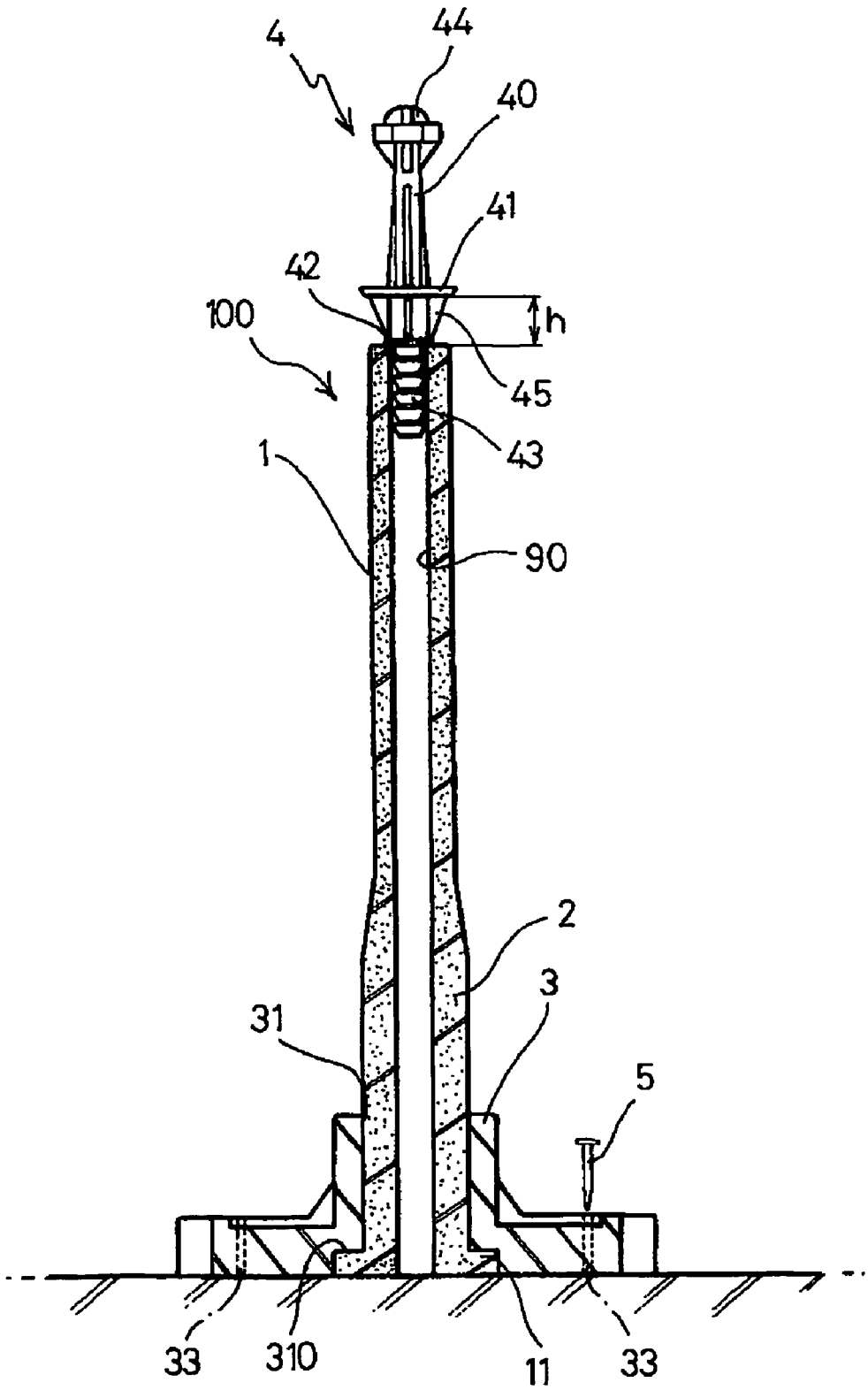
FIG. 3 is a sectional view showing the internal constitution of the levelling rod for plaster work according to the present invention.

FIGS. 2 and 3 show an embodiment of a levelling rod 100 used to maintain the level of mortar poured onto the floor of a building constant. The levelling rod 100 comprises a rod for plaster work 1, a fixing member 3 and a cap 4.

In this embodiment, the rod for plaster work 1 includes a hollow 90 therethrough and a fixing flange 11 formed at a lower end.

Preferably, the rod for plaster work 1 is made of flexible rubber, and it is tapered in the middle part for the improvement of stability or the force of restitution.

This is because a hose for supplying mortar is heavy and moves in various directions due to the pressure for pouring mortar on the floor. That is, the rod 1 can restitute to its original position and shape even after the impact or pressure is imposed on its part by the heavy and mobile hose for the supply of mortar, since it is made of resilient rubber and tapered in the middle part to have a larger diameter in the lower part.

In regard to the fixing member 3 which is engaged with the rod for plaster work 1, an aperture 31 is formed in the center of the fixing member 3 so that the rod 1 can be releasably coupled therewith, and a plurality of fixing holes 33 are formed at the outer periphery of the fixing member 3. Through the fixing holes 33, the fixing member 3 is fixed on the floor of a building by fixing means 5.

In addition, a finger stop 310 is formed at a lower end of the aperture 31 so that the rod for plaster work 1, of which the fixing flange 11 is engaged with the finger stop 310, can be prevented from being released from the fixing member 3.

The cap 4 is provided above the rod for plaster work 1. The cap 4 includes a grip 40 formed in its upper part and a finish line member or a height gauge member 41 in the middle part thereof.

In the lower part of the cap 4, a screw 43 is formed to facilitate the insertion and release of the cap 4 to and from the rod for plaster work 1, and a projecting part 42 of which the diameter is larger than that of the hollow 90 of the rod 1 is provided above the screw 43 in order to prevent the screw 43 from being inserted into the hollow 90 beyond a certain depth.

Further, a guide member 45 may be provided around a surface layer part (h) between the projecting part 42 and the finish line member 41.

On the top of the grip 40 of the cap 4, an indicator 44 is formed so that workers can distinguish it from the floor plastered with mortar by naked eyes.

The surface layer part h is about 20 mm high. The guide member 45 formed on the surface layer part h prevents the cap 4 from being forcibly released from the rod 1 by a plastering knife during the finishing touches after pouring mortar on the floor of a building.

Further, the indicator 44 is stained with mortar during the course of pouring mortar on the floor, and it can be easily distinguished at a long distance during working hours and also in removing the cap 4 from the floor. The indicator 44 can also serve to guide the cap 4, when the cap 4 is inserted into the hollow 90 in the center of the rod 1 and it is removed from the rod 1.

Figure 4:
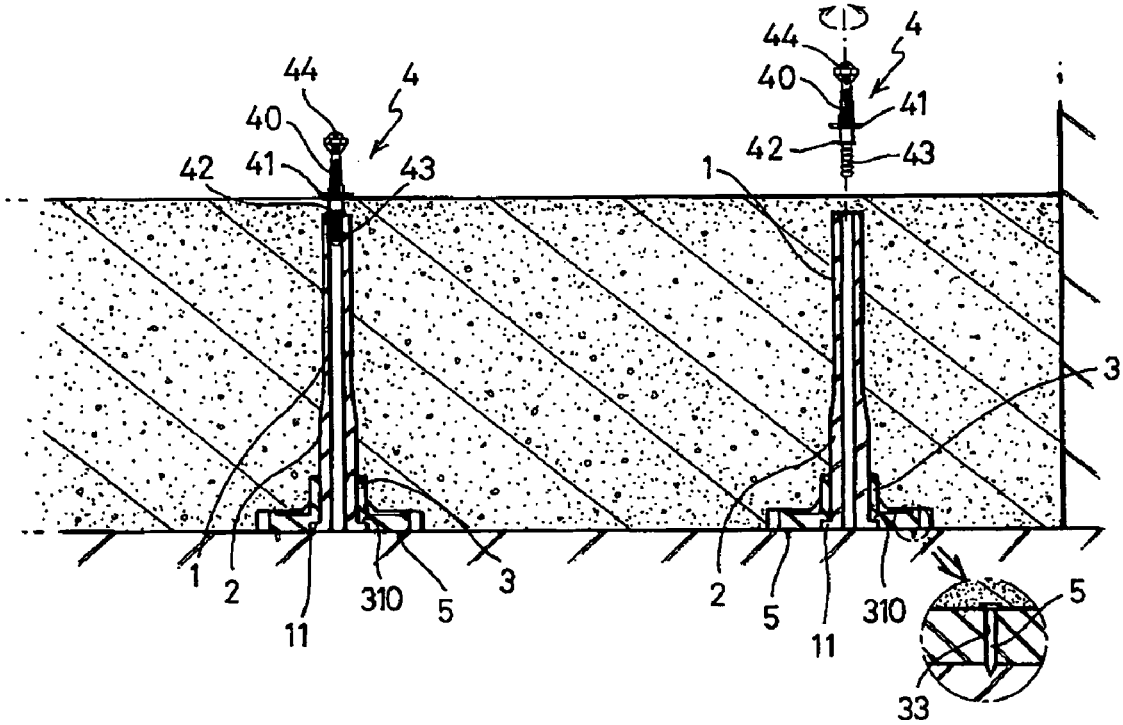
FIG. 4 is a sectional view showing the state wherein the construction of plastering mortar on the floor of a building is done by installing the levelling rods of the present invention.

Specifically, as shown in FIG. 4, the rod for plaster work 1 having the hollow 90 therethrough is inserted into the aperture 31 of the fixing member 3, and the fixing flange 11 formed at an end of the rod 1 is engaged with the finger stop 310 formed at the bottom of the aperture 31.

Then, the fixing member 3 is placed on a certain position of the floor and it is fixed on the floor by fixing means 5 through the fixing holes 33.

Other fixing members, which are coupled with other rods for plaster work, are installed on various positions on the floor at regular distances of about 3 m from one another, by fixing means through fixing holes.

Then, the rod 1 is cut to a desired height according to its use, and the cap 4 is inserted into the hollow 90 of the rod 1.

After mounting the cap 4 on the rod 1 by the screw 43, mortar is poured onto the floor of a building.

If the level of mortar poured on the floor is below the finish line member 41, or if the mortar is poured above the finish line member 41 to the extent that the finish line member 41 cannot be seen, it is required that the mortar be distributed evenly by using a conventional push stick.

After the work of distributing mortar evenly on the floor is finished, the surface of the mortar is cured according to conventional methods, and then plastering work is done on the surface of the mortar.

The cap 4 is removed from the rod 1 before commencing the plastering work, since the grip 40 and the indicator 44 of the cap 4 can be obstacles during the plastering work.

When the cap 4 is removed from the rod 1, the surface of the mortar extends as high as the surface layer part h of the cap 4 which has been removed. That is, a hole corresponding to the removed surface layer part h of the cap 4 is formed above the rod 1 by the removal of the cap 4. Then, the mortar distributed around the hole fill up the hole above the rod 1.

Figure 5:
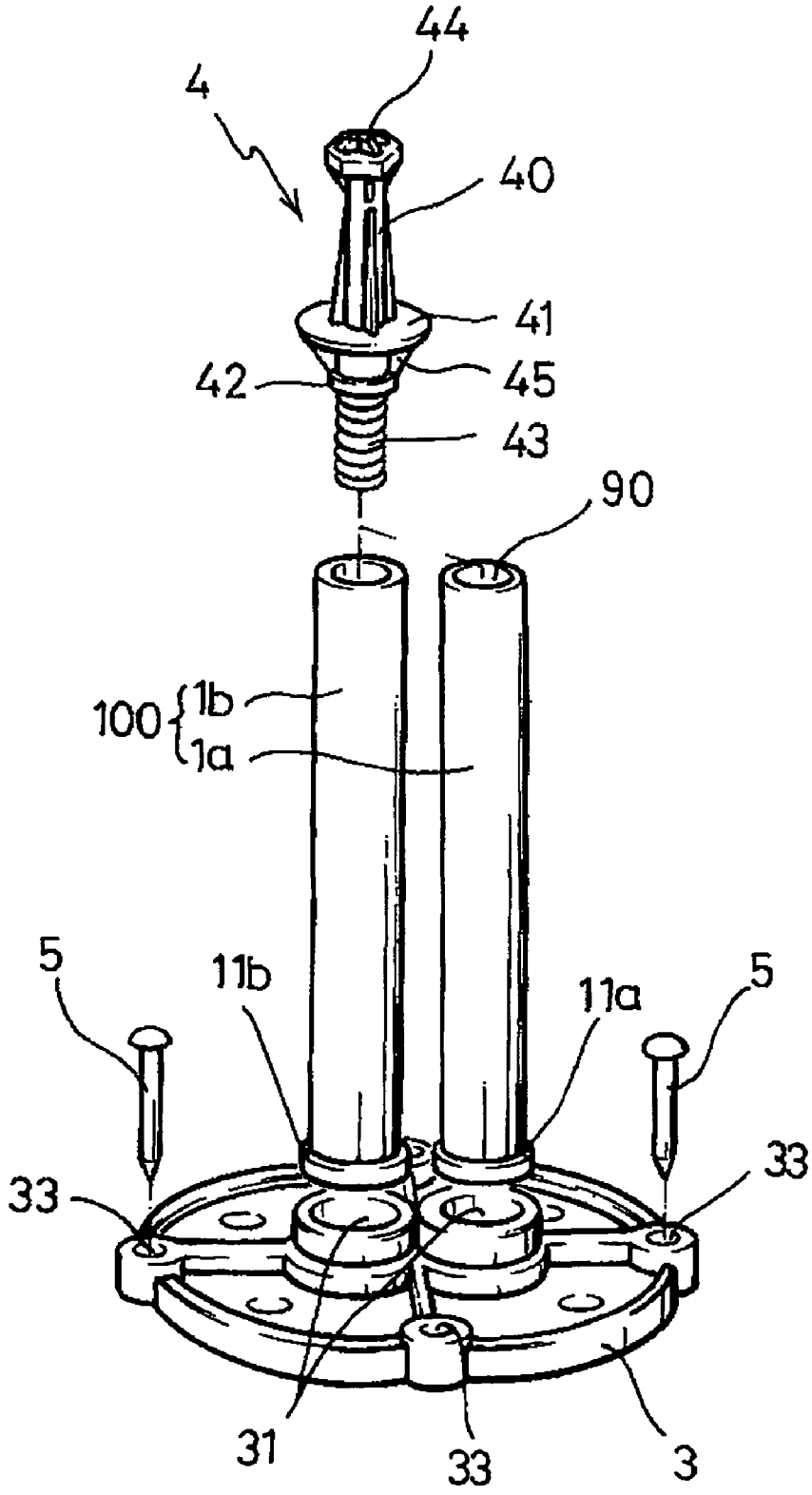
FIG. 5 is a disassembled perspective view of levelling rods for construction of the floor of a room according to the present invention.
Figure 6:
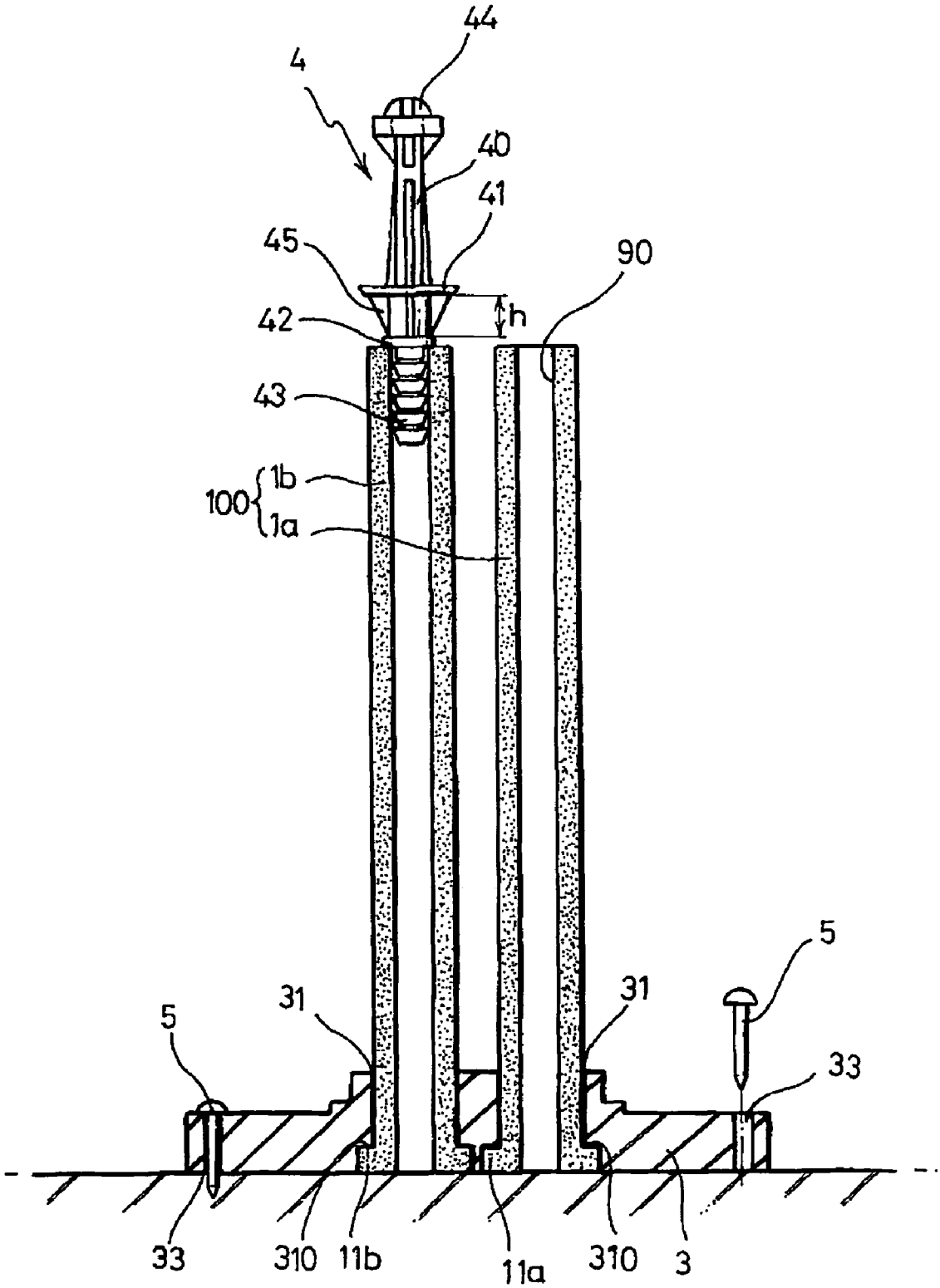
FIG. 6 is a sectional view showing the internal constitution of the levelling rods for construction of the floor of a room according to the present invention.

FIGS. 5 and 6 show another embodiment of the present invention. They show levelling rods 100 for construction of the floor of a room according to the present invention, which comprise a rod for aerated concrete 1*a* and a rod for plaster work 1*b*. The rod for aerated concrete 1*a* and the rod for plaster work 1*b* are of the same height.

Each of the rods 1*a* and 1*b* has a hollow 90 therethrough, and has a fixing flange 11*a* or 11*b* respectively at one end.

Figure 7:
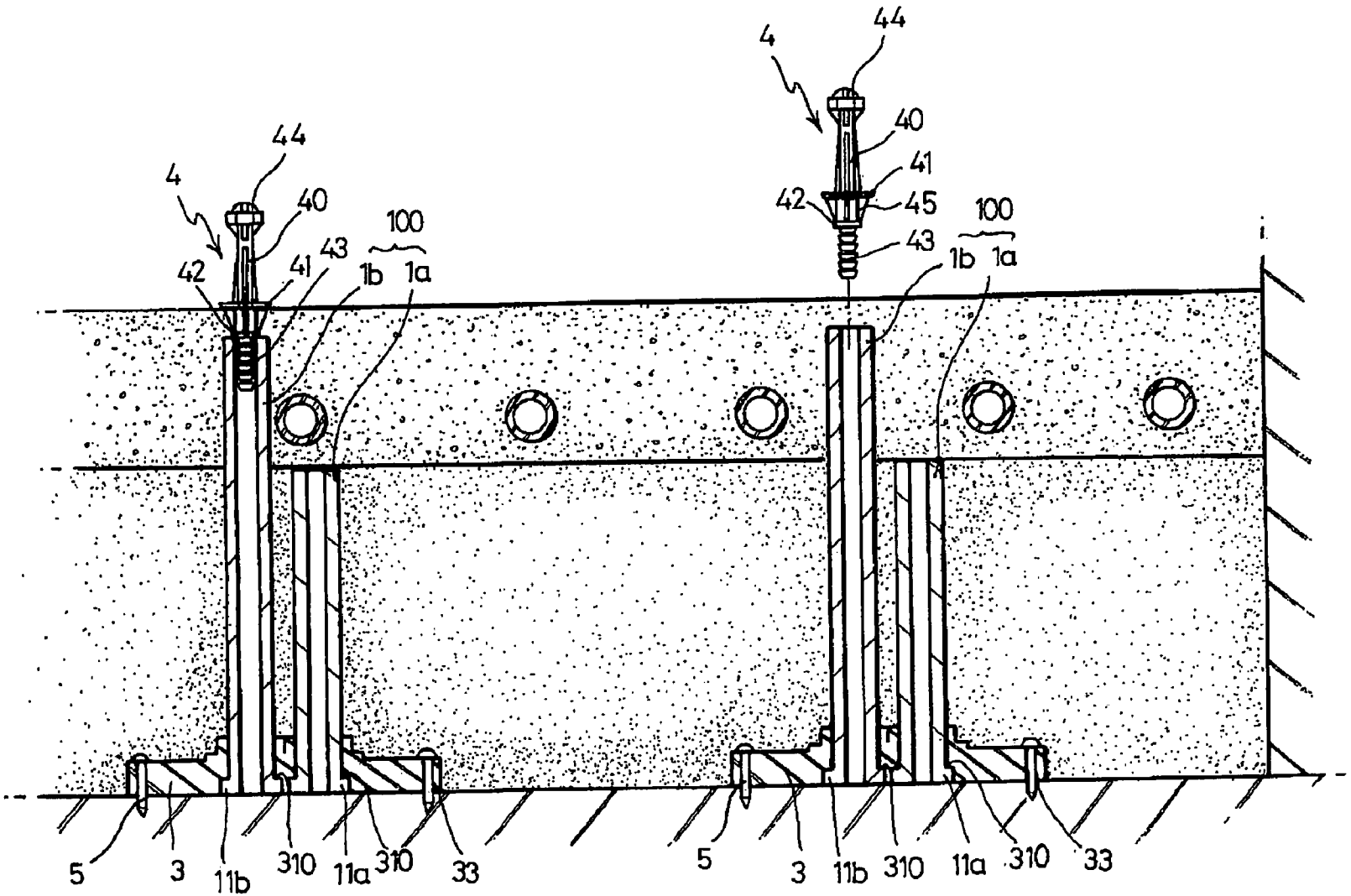
FIG. 7 is a sectional view showing the state wherein the air-conditioning and heating construction of the floor of a room is done by installing levelling rods of the present invention.

As shown in FIG. 7, in order to applying the levelling rods 100 according to the present invention for the air-conditioning and heating construction of the floor of a room, the height of the rods 1*a* and 1*b* is adjusted to be different. Specifically, after the rods 1*a* and 1*b* for aerated concrete and plaster work are inserted into the apertures 31 of the fixing member 3, and the fixing flanges 11*a* and 11*b* are engaged with the finger stops 310 formed at the bottom of the apertures 31, the fixing member 3 is placed on the floor and it is fixed on the floor by fixing means 5 through the fixing holes 33. Then, the rods 1*a* and 1*b* are respectively cut to predetermined heights which differ according to their usages, and aerated concrete is poured on the floor up to the height of the rod of aerated concrete 1*a*.

If the end of the rod 1*a* stained with aerated concrete can be observed by naked eyes, further aerated concrete needs to be supplied, and if the rod 1*a* cannot be seen by naked eyes over the aerated concrete, it means that the concrete is excessively supplied. Therefore, it is preferred that the aerated concrete is poured on the floor substantially as high as the top end of the rod for aerated concrete 1*a*.

After curing the concrete surface according to a conventional method, heating pipes are installed on the surface of the cured concrete, and then a cap 4 is inserted into the hollow 90 of the rod for plaster work 1*b*.

Since the diameter of heating pipes is approximately 20 mm, and the surface layer of mortar is to be about 30 mm thick, and since the surface layer part h of the cap 4 is about 20 mm high, the rod for plaster work 1*b* should be higher than the surface of the aerated concrete, which has substantially the same height as the rod 1*a*, by about 30 mm.

After the cap 4 is coupled with the rod for plaster work 1*b*, mortar is poured onto the aerated concrete, and then plastering work is done, as mentioned above.

Figure 8:
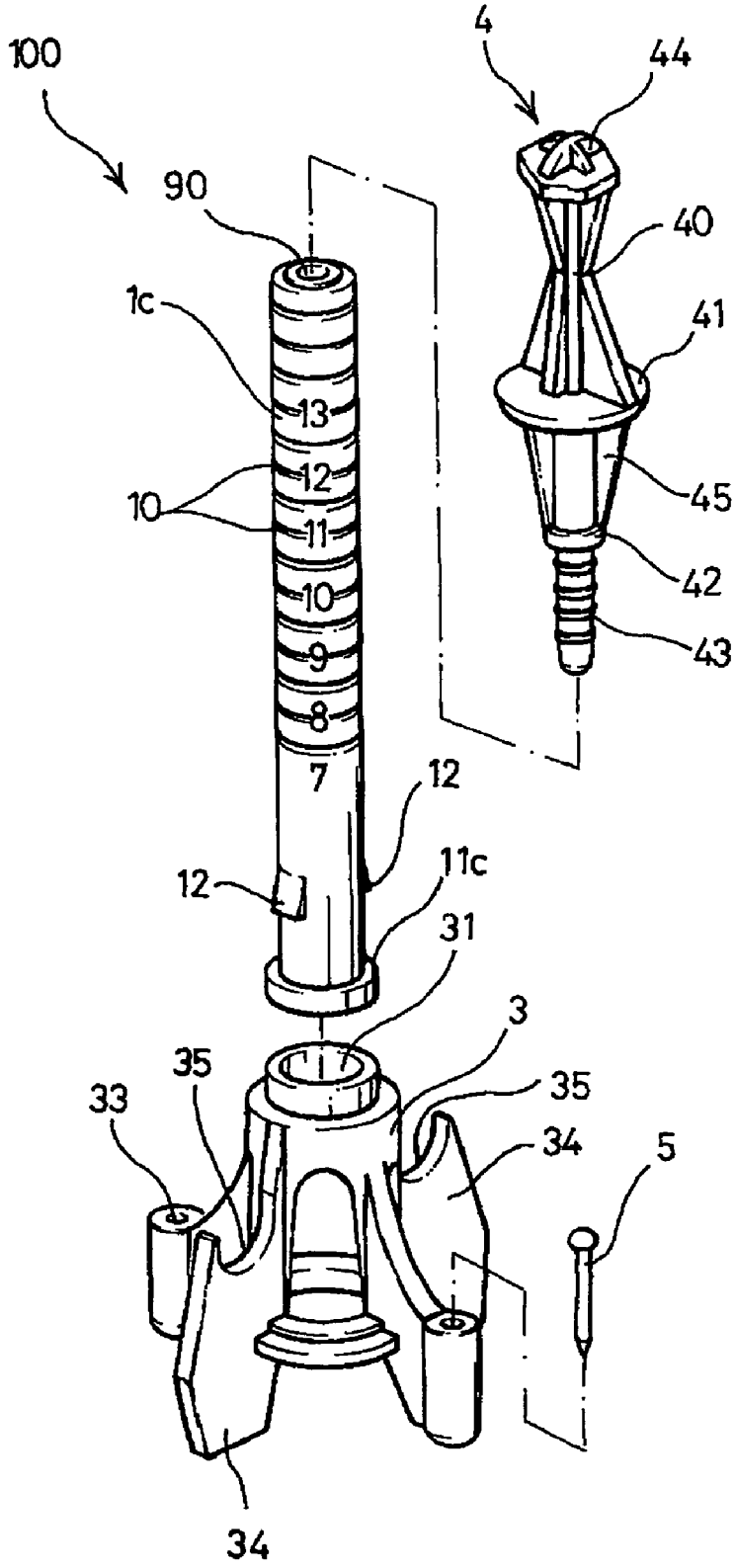
FIG. 8 is a disassembled perspective view of a levelling rod for construction steel work according to the present invention.

FIG. 8 shows a levelling rod for construction steel work 100 according to the present invention. In this levelling rod, a plurality of furrows 10 are engraved on the periphery of a rod for steel work 1*c*, so that the length of the rod 1*c* can easily be adjusted according to the requirement for the height of the concrete poured on the floor. Numerals or letters are inscribed on the furrows 10. As serial numerals are inscribed on the furrows 10, workers can easily control the supply of mortar.

The rod for steel work 1*c* has projecting parts 12 formed in the lower part below the furrows 10 to prevent the release of the rod from the fixing member 3. The projecting parts 12 firmly fit the rod for steel work 1*c* within the fixing member 3.

In addition, supporting members 34 may be formed on opposite sides of the periphery of the fixing member 3, and the upper part of each of the supporting members 34 is grooved to form a groove 35 for supporting an iron bar.

Figure 9:
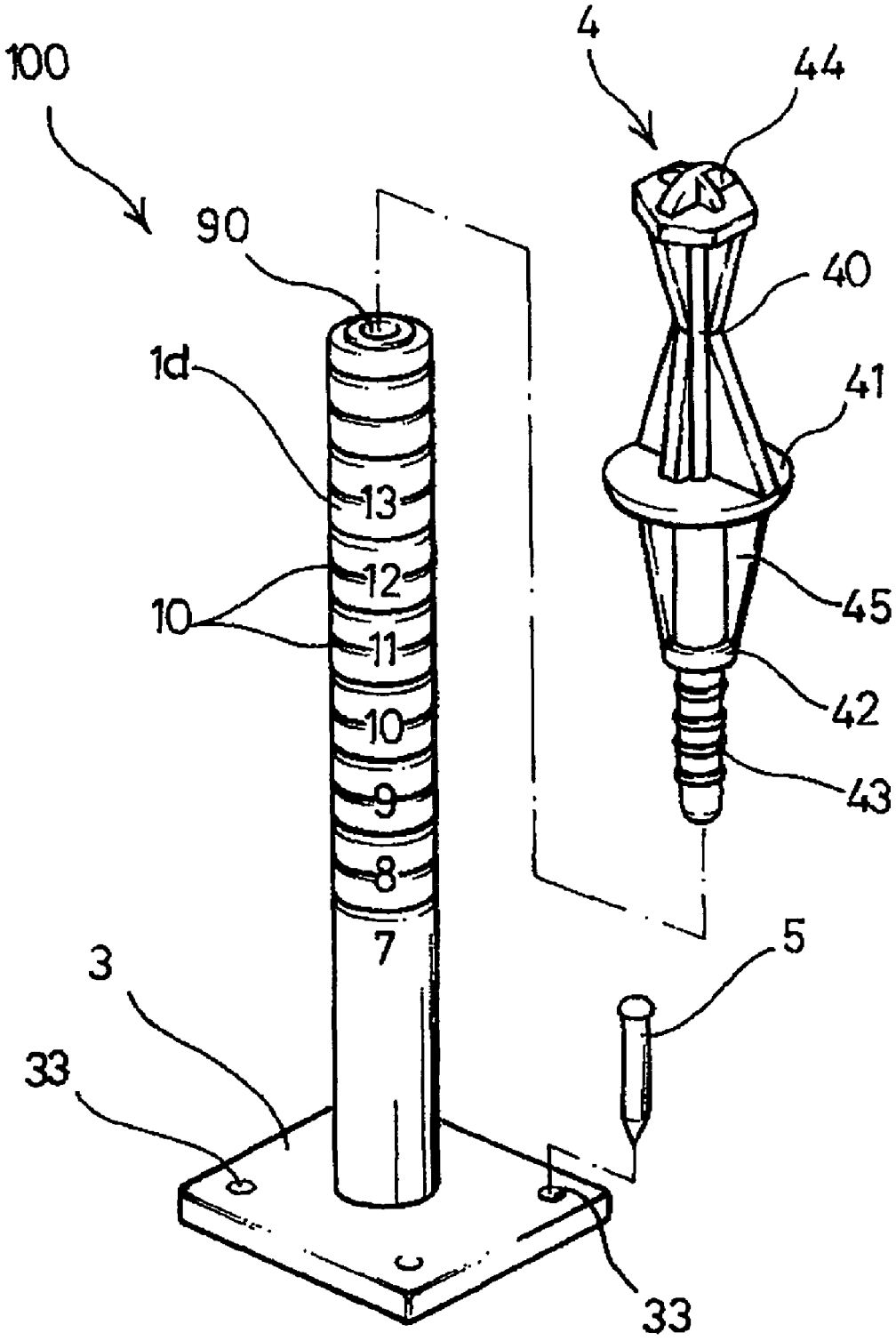
FIG. 9 is a disassembled perspective view of a levelling rod for use in deck plates according to the present invention.

In FIG. 9 which shows a levelling rod for use in deck plates 100, a rod 1*d* is used for the construction of the floor of a building, on which a wire net is installed.

As the slab is formed 70 to 80 mm thick, a fixing member 3 may be installed on the floor by applying an adhesive on its bottom surface.

As mentioned above, a levelling rod 100 can be designed variably according to the purposes or conditions of construction, and therefore it becomes possible to promote an accurate construction and shortening of the term for construction, and to reduce costs for materials and labor costs.

INDUSTRIAL APPLICABILITY

As described above, according to the present invention, it is possible to prevent a defective construction by providing a levelling rod which enables the level of aerated concrete poured onto the floor of a building to be kept constant according to the level required by a design drawing.

Further, according to the present invention, an accurate levelling of the floor of a building can be achieved, and an error in the floor levelling can be minimized. Therefore, it becomes possible to reduce the costs for materials and labor, and the term for construction can be shortened since a repair work can considerably be reduced.

Furthermore, due to the increase of the stability of buildings, it can be expected to prolong the life of buildings.

It will be apparent to those skilled in the art that various modifications and variations can be made to the present invention without departing from the spirit and scope of the invention. The present invention covers the modifications and variations provided they come within the scope of the appended claims and their equivalents.

What is claimed is:

1. A leveling rod for building construction comprising:

a rod having a hollow therethrough and a fixing flange for fitting with a fixing member at a lower end;

the fixing member including an aperture in the center thereof to be releasably coupled with the rod, fixing holes on the outer periphery thereof, through which the fixing member is fixed on the floor of a building by fixing means, and a finger stop formed at an end of the aperture to be fitted with the fixing flange of the rod;

a cap releasably coupled with the hollow of the rod;

wherein the hollow extends through the entire length of the rod;

wherein the cap comprises a screw to be inserted into the hollow of the rod, a projecting part having a diameter larger than that of the hollow of the rod and provided above the screw and fixed relative to the screw in order to prevent the screw from being inserted into the hollow beyond a certain predetermined depth, a finish line member provided above the projecting part and in a fixed position relative to the screw and the projecting part, a guide member provided on a surface layer part located between the projecting part and the finish line member, a grip formed above the finish line member, and an indicator formed on the top of the grip so that workers can distinguish the cap from a floor plastered with mortar or cement; and wherein the length of the rod is adjusted to obtain a desired height of the concrete or mortar poured on the floor.

2. A leveling rod as claimed in claim 1, wherein a plurality of furrows are engraved on the periphery of the rod, so that the length of the rod can be adjusted according to the height of the concrete or mortar poured on the floor.

3. A leveling rod as claimed in claim 1, wherein the rod is tapered in its middle part by an increasing diameter extending between its upper part and lower part so that its upper part and lower part have different diameters.

4. A leveling rod as claimed in claim 2, wherein projecting parts are formed on the lower periphery of the rod to prevent the release of the rod from the fixing member and the projecting parts are below the furrows.

5. A leveling rod as claim in claim 1, wherein projecting parts are formed on the lower periphery of the rod to prevent the release of the rod from the fixing member.

6. A leveling rod as claim in claim 1, wherein the screw directly engages the hollow of the rod.

7. A leveling rod as claim in claim 1, wherein the surface layer part is cylindrical and the guide member is formed to prevent the cap from being forcibly released from the rod by a plastering knife when finishing the floor.

8. A leveling rod for building construction comprising:

a rod having a hollow therethrough and a fixing flange for fitting with a fixing member at a lower end;

the fixing member including an aperture in the center thereof to be releasably coupled with the rod, fixing holes on the outer periphery thereof, through which the fixing member is fixed on the floor of a building by fixing means, and a finger stop formed at an end of the aperture to be fitted with the fixing flange of the rod;

a cap releasably coupled with the hollow of the rod;

wherein the hollow extends through the entire length of the rod;

wherein the cap comprises a screw to be inserted into the hollow of the rod, a projecting part having a diameter larger than that of the hollow of the rod and provided above the screw and fixed relative to the screw in order to prevent the screw from being inserted into the hollow beyond a certain predetermined depth, a finish line member provided above the projecting part and in a fixed position relative to the screw and the projecting part, a guide member provided on a surface layer part located between the projecting part and the finish line member, a grip formed above the finish line member, and an indicator formed on the top of the grip so that workers can distinguish the cap from a floor plastered with mortar or cement;

wherein a plurality of furrows are engraved on the periphery of the rod, so that the length of the rod can be adjusted according to the height of the concrete or mortar poured on the floor;

wherein projecting parts are formed on the lower periphery of the rod to prevent the release of the rod from the fixing member and the projecting parts are below the furrows; and wherein the surface layer part is cylindrical and the guide member is formed to prevent the cap from being forcibly released from the rod by a plastering knife when finishing the floor.

9. A leveling rod as claimed in claim 8, wherein the rod is tapered in its middle part by an increasing diameter extending between its upper part and lower part so that its upper part and lower part have different diameters.

* * * * *